US005463405A

United States Patent [19]

Liu et al.

[11] Patent Number: 5,463,405

[45] Date of Patent: Oct. 31, 1995

[54] CELLULAR TELEPHONE COUPLING NETWORK

[75] Inventors: Duixian Liu, Dayton; Glenn L. Cota, Piqua, both of Ohio

[73] Assignee: Valor Enterprises, Inc., Piqua, Ohio

[21] Appl. No.: 246,734

[22] Filed: May 20, 1994

[51] Int. Cl.[6] ..... H01Q 1/32

[52] U.S. Cl. ..... 343/715; 343/850; 343/860; 333/24 C

[58] Field of Search ..... 455/89, 129, 280, 455/281, 282, 289, 290, 345; 343/713, 715, 860, 864, 850, 852, 861, 862; 333/24 C

[56] References Cited

U.S. PATENT DOCUMENTS

| | | | |
|---|---|---|---|
| 1,778,395 | 10/1930 | Lindenblad | 333/33 |
| 2,109,219 | 2/1938 | McKeel | 333/32 |
| 2,190,131 | 2/1940 | Alford | 333/127 |
| 2,226,686 | 12/1940 | Alford | 333/126 |
| 2,245,693 | 6/1941 | Lindenblad | 343/826 |
| 2,344,884 | 3/1944 | Kirkland | 343/814 |
| 2,448,036 | 8/1948 | Libby | 333/23 |
| 2,530,995 | 11/1950 | Rumpf, Jr. | 331/170 |
| 2,559,613 | 7/1951 | Halstead | 455/6.1 |
| 2,583,133 | 1/1952 | Anderson et al. | 334/71 |
| 2,611,822 | 9/1952 | Bliss | 333/32 |
| 2,829,367 | 4/1958 | Rychlik | 343/850 |
| 3,262,075 | 7/1966 | Podell | 333/32 |
| 3,364,487 | 1/1968 | Maheux | 343/702 |
| 3,453,618 | 7/1969 | Ukmar et al. | 343/715 |
| 3,657,652 | 4/1972 | Smith | 343/872 |
| 4,001,834 | 1/1977 | Smith | 343/754 |
| 4,028,704 | 6/1977 | Blass | 343/715 |
| 4,089,817 | 5/1978 | Kirkendall | 343/713 |
| 4,238,799 | 12/1980 | Parfitt | 343/715 |
| 4,658,259 | 4/1987 | Blaese | 343/715 |
| 4,764,773 | 8/1988 | Larsen et al. | 343/713 |
| 4,794,319 | 12/1988 | Shimazaki | 343/715 |
| 4,804,969 | 2/1989 | Blaese | 343/715 |
| 4,839,660 | 6/1989 | Hadzoglou | 343/715 |
| 4,850,035 | 7/1989 | Schiller | 455/109 |
| 4,862,183 | 8/1989 | Blaese | 343/715 |
| 4,999,642 | 3/1991 | Wells | 343/822 |
| 5,023,622 | 6/1991 | Blaese | 343/715 |
| 5,099,252 | 3/1992 | Bryant et al. | 343/713 |
| 5,278,572 | 1/1994 | Harada et al. | 343/715 |
| 5,283,589 | 2/1994 | Blevins | 343/715 |
| 5,343,214 | 8/1994 | Hadzoglou | 343/713 |

FOREIGN PATENT DOCUMENTS

| | | | |
|---|---|---|---|
| 137391 | 4/1985 | European Pat. Off. . | |
| 3537107 | 4/1987 | Germany | 343/711 |
| 57-145402 | 9/1982 | Japan . | |
| 0136128 | 2/1989 | Japan | 343/711 |
| 0177230 | 3/1989 | Japan . | |

OTHER PUBLICATIONS

Six (6) photographs of prior art cellular telephone antenna coupling network box made by Valor Enterprises, Inc.

K. C. Gupta, R. Garg, and R. Chadha Computer Aided Design of Microwave Circuits, pp. 56–57 and 60–63, (Artech–1981).

R. Collin Foundations for Microwave Engineering, pp. 212–213 (McGraw–Hill 1966).

Reference Data for Radio Engineers pp. 22–13 to 22–18 (Howard W. Sons & Co. 1974–Fifth Edition).

*Primary Examiner*—Donald Hajec
*Assistant Examiner*—Tan Ho
*Attorney, Agent, or Firm*—Wood, Herron & Evans

[57] ABSTRACT

A cellular telephone coupling network (12) includes a generally rigid dielectric substrate (50) having a pair of tuning stubs (64, 66) formed thereon by confronting thin conductive strips (68, 70) and (72, 74) positioned on opposite face surfaces (60, 62) of the substrate (50). A unique conductive strip pattern is provided for the coupling network (12) which permits broad tunability while allowing the coupling network to be fit within the confines of a small plastic housing (32). To this end, the stubs (64, 66) are shaped as generally open, rectangular loops comprising a series of straight leg sections (94, 96, 102, 106) connected end to end around the edges of the substrate (50) with the stub distal ends (108, 112) heading back toward the respective stub proximal ends (92, 110) but stopping short thereof. One of the stubs includes an extension leg section (114) to make it longer than the other stub for greater tunability.

43 Claims, 3 Drawing Sheets

10
24
14
16
15
20
23
26
25
3
18
22
28
2
50
52
60
36
81
62
12
83
85
84
55
58
57
44
32
33
49
43
40
42
56
54
3
34
38
46b
48
TRANSCEIVER
46
2
46a

CELLULAR TELEPHONE COUPLING NETWORK

FIELD OF THE INVENTION

This invention relates generally to cellular telephone systems in vehicles and more particularly to a coupling network to provide impedance matching between an external, glass-mounted antenna and a transceiver cable over a wide range of cellular telephone frequencies.

BACKGROUND OF THE INVENTION

Automobile-based, cellular telephones generally comprise a handset and transceiver unit mounted inside the automobile with the transceiver unit coupled to an external antenna structure through a coaxial transmission cable. The antenna structure is normally externally mounted to a glass automobile window, such as the rear windshield. The antenna structure includes a mono-pole antenna connected to a flat coupling plate which lies against the outside surface of the windshield. Mounted on the interior surface of the windshield and opposite the antenna coupling plate is another flat coupling plate supported by a plastic or metal housing. The transceiver cable is electrically coupled to the inside coupling plate. The two parallel plates and windshield glass form a capacitive circuit which allows cellular telephone signals to be transmitted and received through the glass and between the antenna and transceiver via the cable.

As with most circuits operating at radio frequencies or RF, there is an impedance mismatch in cellular telephone systems between the impedance of the transceiver cable and the impedance of the coupling plates and antenna. The impedance mismatch causes a power reflection at the connection point between the plates and the cable, and a reflected standing wave results. The reflected power reduces the efficiency of the system, interferes with the telephone signals passing through the system and creates stray radiation within the automobile. To improve the operation of cellular telephones, a coupling network is usually placed in-line between the coupling plates and cable to provide an impedance match between the antenna and plates and the cable thus reducing the reflected power.

Generally, the transceiver cable is a coaxial cable having an inner conductor and an outer ground foil covering and is connected between the coupling network and the cellular telephone transceiver. The cable end opposite the transceiver is connected to a coaxial connector having a center conductor and an outer shell to mate with the inner conductor and outer ground foil of the cable. The connector center conductor and shell are, in turn, electrically coupled to the coupling network. The coupling network is also electrically connected to the interior coupling plate and through the glass to the outer plate and antenna. Thereby, coupling networks provide impedance matching between the coaxial transceiver cable and the antenna, and should ideally operate to ensure efficient and generally interference-free transmission and reception of the cellular telephone signals.

While currently available coupling networks provide a certain degree of electrical impedance matching between the transceiver cable and the antenna, many of the commercially available antenna coupling networks do not operate as well as desired. For example, some do not provide sufficient impedance matching. Consequently, there is an undesirable amount of reflected RF energy on the transceiver cable which degrades the quality of the telephone signal, and results in radiating undesirable RF energy into the interior of the automobile. Further, other matching networks are not readily tunable to operate over the three currently-existing cellular telephone frequency bands. These bands are 824–896 MHz for the U.S., 895–960 MHz for Europe and 806–866 MHz for the U.S. Special Mobile Radio or SMR market.

One proposed solution for preventing stray radiation from the coupling network has been to enclose the coupling network in an electrically conductive metal housing which is electrically connected to the connector shell to ground the housing. The housing acts as a so-called "counterpoise" to maintain the coupling network electrically "cool" and reduce the reflection and undesired radiation that results. However, use of a counterpoise requires a formed metal housing which is expensive to manufacture, thus increasing the cost of the system.

Further, the metal housing becomes part of the electrical circuit which may affect performance of the coupling network depending upon its placement relative to the metal of the vehicle. The metal housing also provides a source of potential radiation and reception problems should a loose connection within the housing accidentally contact the housing. An alternative has been to provide a shield near the coupling network that is grounded to the metal of the vehicle about the window. The grounded shield has eliminated some of the problems encountered with use of a counterpoise, but has also led to increased costs and manufacturing complexities.

Therefore, it is desirable to eliminate the cost and other drawbacks associated with a metal housing or shield. To this end, another proposed cellular telephone antenna system uses an electrically closed-loop transformer structure for coupling the antenna to the transceiver cable. The closed-loop transformer is already electrically "cool" and thus has minimal reflections so that both the counterpoise and the grounded shield may be completely eliminated. However, the transformer structure is not without its own drawbacks. In particular, the rigid, metal preform of the transformer structure has a fixed dimension and thus is limited in its tunability and operability over the currently available cellular telephone frequency band ranges. Furthermore, the rigid metal preform is somewhat fragile and susceptable to movement or bending during installation and use which modifies its electrical characteristics and thus degrades its operation.

SUMMARY OF THE INVENTION

The present invention provides a cellular telephone coupling network that has the advantages associated with closed-loop transformers to thus eliminate any need for either a counterpoise or grounded shield, yet does not suffer from the drawbacks previously associated with such closed-loop transformers. To this end, and in accordance with the features of the present invention, the coupling network is provided by a generally rigid dielectric substrate having two pairs of tuning stubs formed thereon with each tuning stub being defined by a pair of confronting thin conductive strips positioned on opposite face surfaces of the substrate. One of the strips of each stub is connected to the connector center conductor and the other strip is connected to the outer shell. One of the strips connected to the center conductor is also connected to the interior coupling plate. The substrate and coupling plate may be contained within a non-conducting plastic housing. The electrical lengths of the stubs are adjusted by shorting clips selectively placed along the mechanical length of each pair of strips to electrically couple the strips of each stub together at the clips to thus tune the network and to provide impedance matching between the transceiver cable and the antenna.

As mentioned, each of the tuning stubs are defined by confronting pairs of thin conductive strips on opposite sides of the substrate. In order to facilitate tuning over a broad range of cellular telephone frequencies without requiring a counterpoise or grounded shield and to fit the stubs within the confines of a small plastic box, there are limitations on the mechanical length of the strips. To this end, and in accordance with one feature of the present invention, a unique conductive strip pattern is provided which fits the stubs onto a small substrate board and further permits tunability of the network over a wide frequency range, such as over one or even all three currently-available cellular telephone frequency bands. Specifically, each tuning stub has an open, generally loop-shaped pattern formed on the substrate. The proximal end of each stub is connected to the coaxial connector and each stub extends away from the coaxial connector and around the edges of the substrate. Each stub generally follows the substrate edges and includes a portion which extends back toward the coaxial connector, but which terminates at a distal end located away from the coaxial connector and the stub proximal end. The distal end of one of the stubs includes an extension leg which increases the effective length of the stub and provides further tunability of the stub and the overall coupling network.

In accordance with still another feature of the present invention, the loop-shaped patterns of the tuning stubs are generally rectangular loops comprising a plurality of straight leg sections attached end to end. Accordingly, each stub includes a first leg section extending away from the coaxial connector to an edge of the substrate, a second leg section extending from the first leg and along the edge of the substrate, a third leg section extending from the third leg and generally parallel to the first leg, and a fourth leg section extending from the third leg and generally parallel to the second leg back toward the first leg and the connector but terminating in a distal end spaced from the coaxial connector. A fifth leg section may be included extending from the fourth leg to increase the effective length of one of the stubs for tunability.

The entire coupling network is thus formed on a single substrate, such as a piece of PC board and is housed within a plastic housing without the need of a counterpoise or a grounded shield. The coupling member, such as a capacitive plate, may be held within the bottom wall of the housing as is conventional. In operation, the entire housing is attached to the interior surface of a glass windshield while an antenna with a similar coupling plate is placed on the exterior surface of the windshield.

By virtue of the foregoing, a coupling network is provided which is readily and easily tunable to operate over the entire range of all three cellular bands to provide impedance matching for a wide variety of telephone systems and antenna networks. Further, the unique configuration and pattern of the tuning stubs provides impedance matching between the transceiver cable and antenna to reduce the reflected power and the undesirable radiation at the connection point between the coupling network and transceiver RF cable without requiring either a grounded metal shield or a counterpoise such as a metal housing. The coupling network is durable and stable and is not particularly sensitive to jarring during installation and use.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the principles of the invention.

DETAILED DESCRIPTION OF THE DRAWINGS

Figure 1:
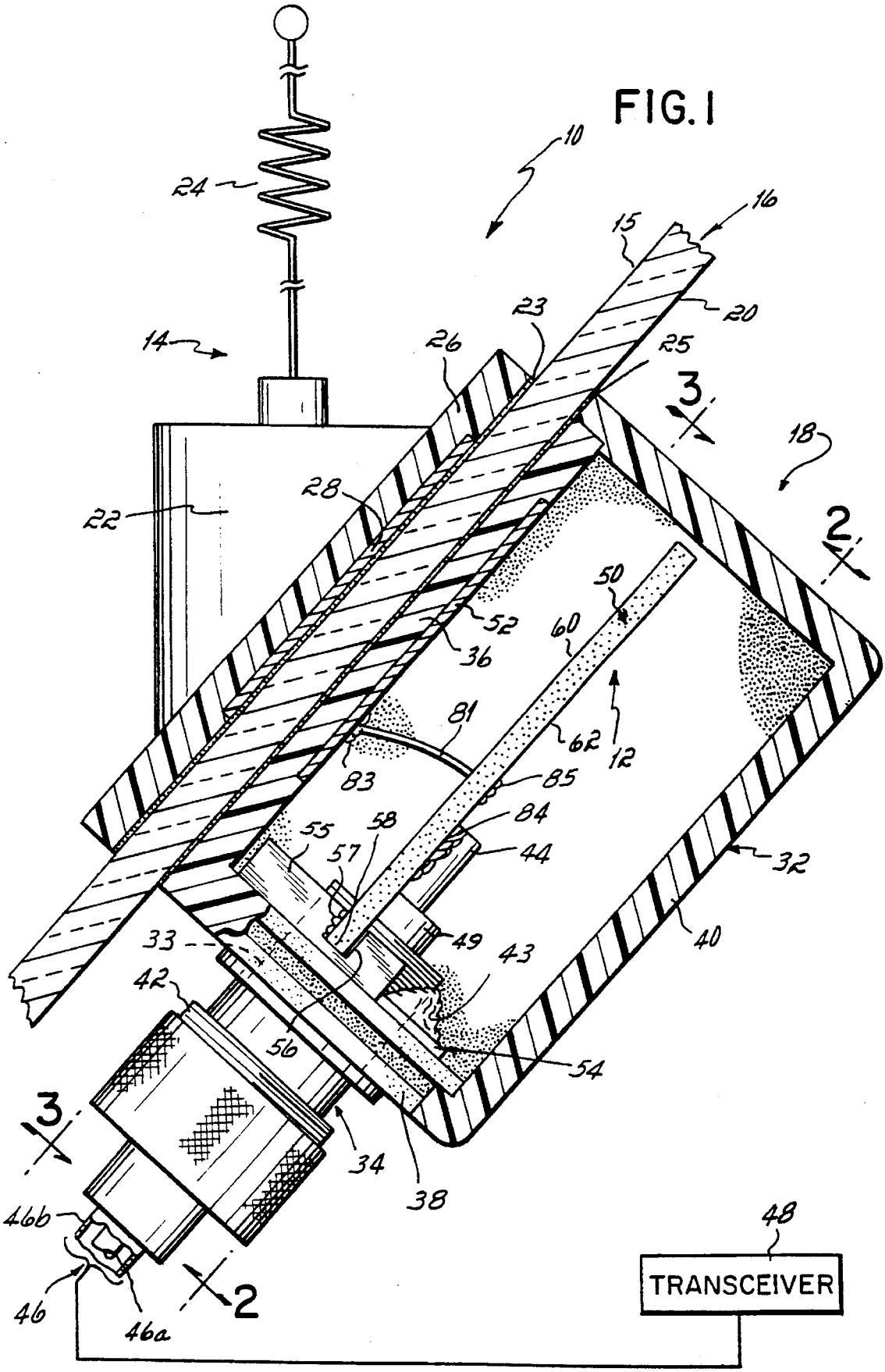
FIG. 1 is a side view, in partial cross section, of a cellular telephone antenna system including a coupling network in accordance with the principles of the present invention.

With reference to FIG. 1, there is shown a cellular telephone antenna system 10 incorporating a coupling network 12 in accordance with the principles of the present invention. System 10 includes an external antenna unit 14 (not shown to scale) installed against the exterior surface 15 of a glass windshield 16, and opposite a coupler box 18 installed against the interior surface 20 of the glass windshield 16. Coupler box 18 houses the coupling network 12 as will be described below in greater detail. Antenna unit 14 includes a stand structure 22 which supports a monopole antenna 24 screwed or otherwise fastened into the stand structure 22 so that it extends vertically for the best signal reception. Stand structure 22 is attached to a generally flat base 26 which contains a flat coupling plate 28 made of a conductive metal such as brass. The base 26 and plate 28 lie flat against the exterior surface 15 of windshield 16 and are attached thereto, such as by a pressure sensitive adhesive layer 23.

Coupler box 18 includes a plastic housing 32 which supports, through an aperture 33 thereof, a typical 50 Ohm coaxial cable connector 34. Plastic housing 32 includes a bottom wall 36 having an integral flange 38 which extends upwardly from bottom wall 36 to define aperture 33 through which the coaxial cable connector 34 passes and is supported. The bottom wall holds an interior conductive coupling element or plate 52 (such as a 0.875 inch diameter and 0.025 inch thick brass disc), while flange 38 supports connector 34 and, as described further hereinbelow, provides support to coupling network 12. Plastic housing 32 also includes a cover 40 which is configured to receive the bottom wall 36 and flange 38 to form a complete housing 32. The bottom wall 36 and complete housing 32 are attached to the interior surface 20 such as by an adhesive layer 25. The plastic housing 32 is configured such that the coupler box is generally rectangular-shaped and has dimensions of about 1.5 inches in width by about 1.5 inches in length by about 0.93 inches in height.

Coaxial cable connector 34 has an outer shell conductor 42 and an inner conductor 44 for connecting to the inner and outer conductors 46*a*, 46*b*, respectively, of a coaxial cable 46 which is connected to a cellular telephone transceiver 48. Outer shell conductor 42 is electrically isolated from center conductor 44 by a sleeve of insulation 49 as is conventional. A generally rigid, rectangular-shaped dielectric substrate 50, such as a piece of PC board, is supported in a fixed relationship with respect to connector 34, and is spaced away from interior coupling plate 52 a distance of about 0.23 inches. Substrate 50 may have dimensions of about 1.25 inches in width and 1.1875 inches in length as indicated by reference numerals 51, 53, respectively. A suitable substrate may be G-10 dielectric about 0.062 inches thick which is commercially available from Circuit Systems, Inc. of Elk Grove Village, Ill.

A brass stand 54 is positioned adjacent flange 38 and has an opening 39 to receive outer shell conductor 42 therethrough. Support stand 54 is soldered to shell 42 as at 43 to secure support stand 54 against flange 38 and to affix the connector 34 to the coupler box 18 (see FIG. 2). Wings 55 of stand 54 have notches 56 to receive the top edge 58 of substrate 50. The wings 55 are soldered as at 57 to contact conductive patches on substrate 50 to secure substrate 50 to stand 54 and to provide an electrical ground connection between shell conductor 42 and substrate 50 as will be described.

Figure 2:
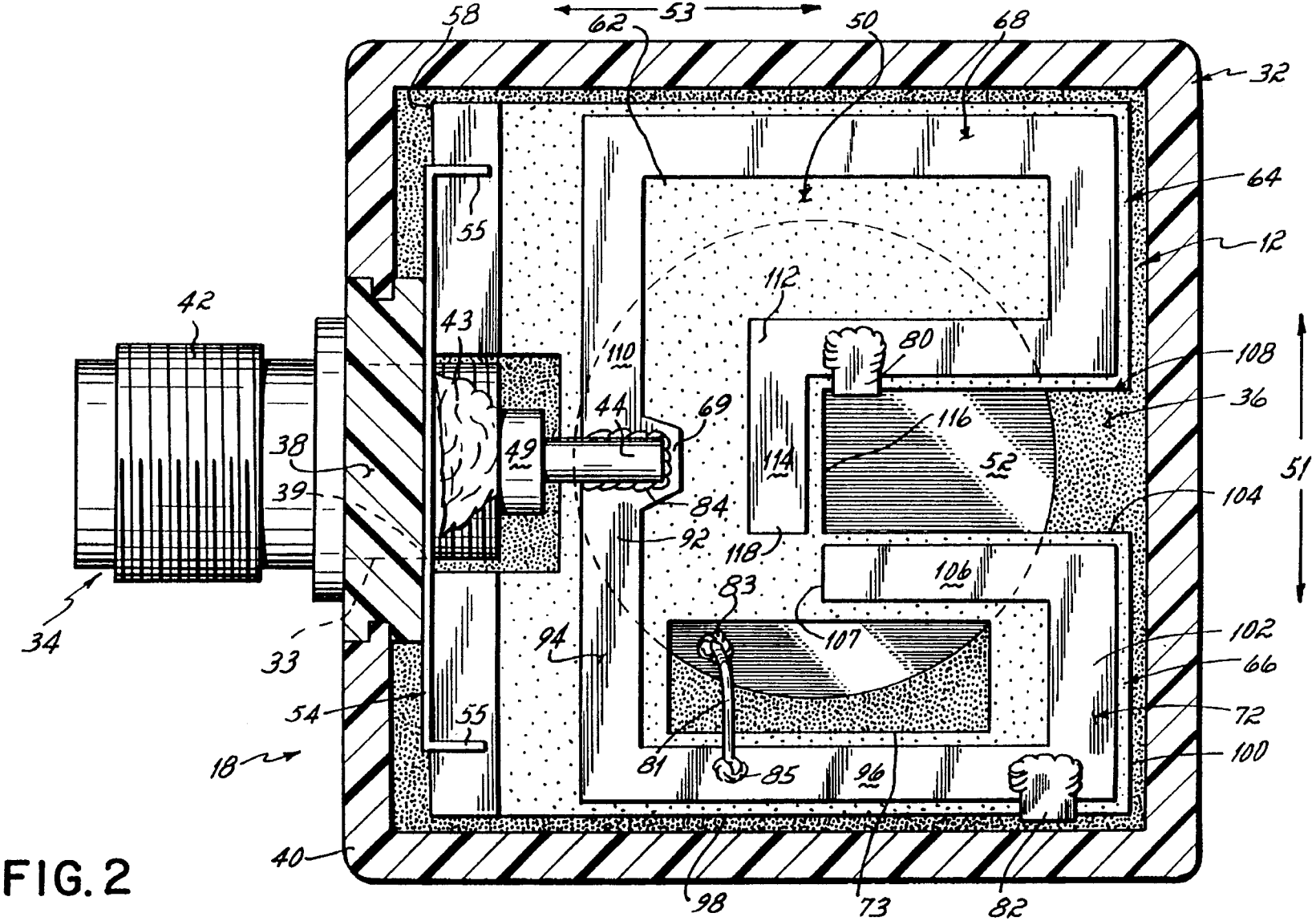
FIG. 2 is a cross section of the coupling network taken along lines 2—2 of FIG. 1.
Figure 3:
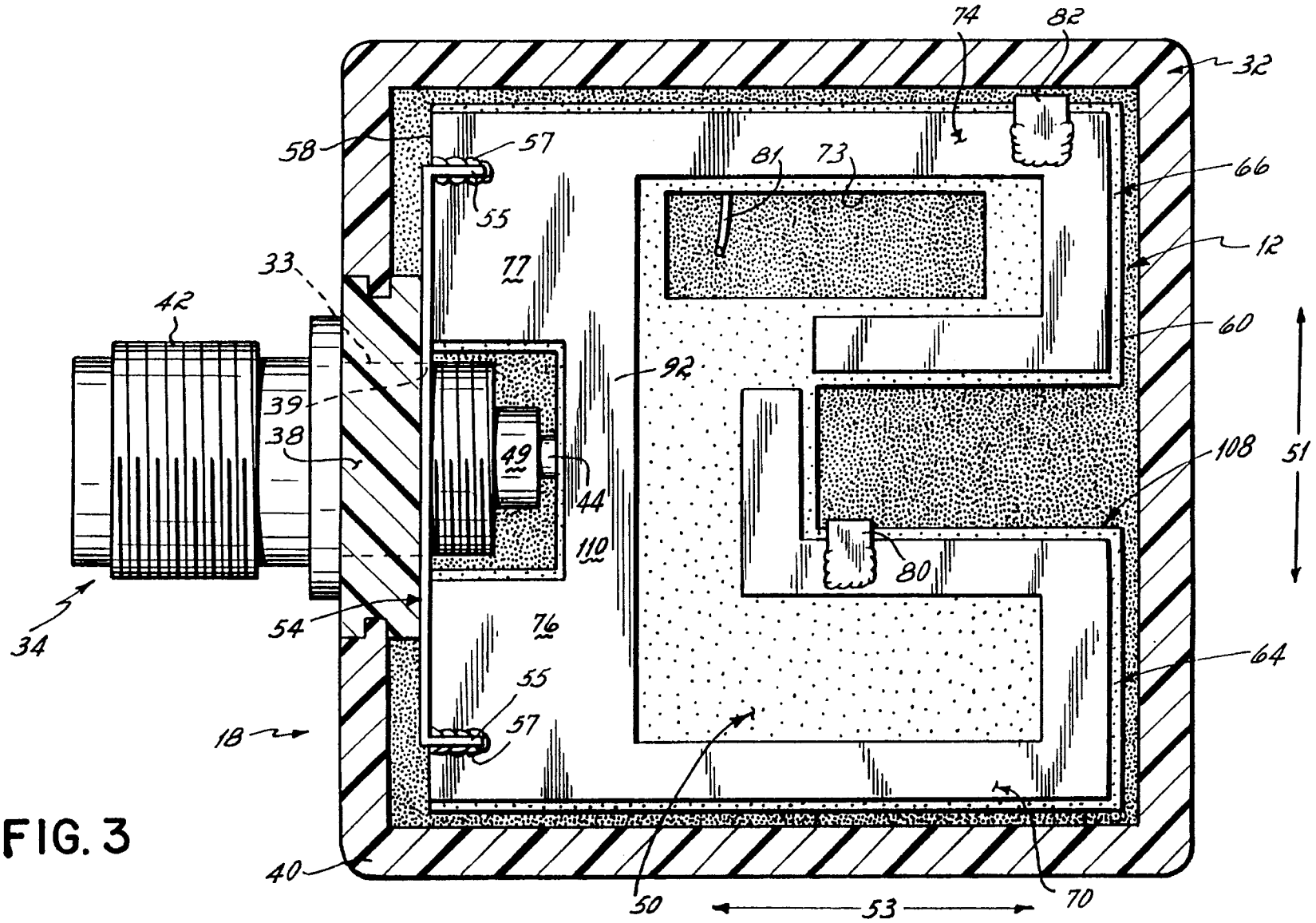
FIG. 3 is a cross section of the coupling network taken along lines 3—3 of FIG. 1.

The tuning stubs of the present invention are formed on substrate 50 by depositing thin conductive strips onto opposite face surfaces 60, 62 of substrate 50 according to well known techniques for depositing conductive contacts and leads on a printed circuit board. Referring now to FIGS. 2 and 3, the coupling network includes a pair of stubs 64, 66 which are formed by thin confronting strips of a suitable metal such as copper formed on opposed face surfaces 60, 62. Specifically, stub 64 is formed by confronting top and bottom strips 68, 70 while stub 66 is formed by confronting top and bottom strips 72, 74. The confronting strips of the stubs 64, 66 generally confront each other across substrate 50 along their entire lengths and have generally equal widths along at least a major portion of their lengths. Both strips 70, 74, however, include wider sections proximate the top edge 58 of substrate 50 which define conductive patches 76, 77, respectively, to allow connection to wings 55 of stand 54 for support and electrical grounding purposes as discussed. Preferably, top strips 68 and 72 on face surface 62 have a width of about 0.1 inches while both strips 70 and 74 on bottom face surface 60 have a slightly larger width of about 0.12 inches except in the area of patches 76, 77 where the width is about 0.35 inches. For ease of manufacturing, strips 68, 72 on face surface 62 and strips 70, 74 on face surface 60 of substrate 50 may be formed as shown in FIGS. 2 and 3 as continuous strips joined at the respective proximal ends 110, 92. Strips 68, 72 of the disclosed embodiment shown in the Figures are joined at extension 69 which provides proper connection of the strips 68, 72 to the center conductor 44 of connector 34 as discussed further hereinbelow. Each of the stubs 64, 66 extends along the edges of the substrate and has a defined electrical length which may be adjusted, i.e., shortened, by conductive metal members such as tuning clips 80, 82, respectively as will also be discussed further hereinbelow. The stubs 64, 66 may be tuned over a wide range of cellular telephone frequencies without requiring a grounded shield or counterpoise. The coupling plate 52 is connected to one of the strips 68, 72 of stubs 64, 66 and preferably to strip 72 of stub 66 by wire 81 and solder connections at 83 and 85 (see FIG. 2). A portion of substrate 50 is cut away to define an opening 73 through which wire 81 passes between plate 52 and strip 72.

The tuning stubs 64, 66 are electrically coupled to connector 34 to electrically connect the coupling network to the transceiver 48 and cable 46. More specifically, the center conductor 44 of connector 34 is connected to strips 68 and 72 such as by a metal solder connection 84 at extension 69. Strips 70, 74 are connected such as by solder at 57 to side notches 56 of brass stand 54 (see FIG. 3), and stand 54, in turn, is connected to the outer shell conductor 42 of connector 34 by a solder connection at 43 (see FIG. 2). Therefore, outer shell conductor 42 is electrically connected to strips 70, 74 through stand 54. The brass stand 54 provides support and electrical connection but could be replaced with alternative support structures and other grounding connections as will be appreciated by those skilled in the art.

In accordance with another feature of the present invention, the confronting strips 68, 70 and 72, 74 of the tuning stubs 64, 66, respectively, are deposited on substrate 50 in a unique pattern which makes the tuning stubs 64, 66 readily and easily tunable over a broad range of frequencies encompassing the cellular telephone frequency ranges of interest. Furthermore, the unique pattern allows the stubs 64, 66 to fit onto a small substrate 50 to form an overall small coupling network without sacrificing tunability over a broad frequency range, and without requiring a counterpoise or grounded shield. Specifically, each of the tuning stubs 64, 66 forms an open, generally loop-shaped pattern, and more specifically an open, generally rectangular loop-shaped pattern. The pattern will be described with respect to tuning stub 66, but it should be understood that tuning stub 64 has a somewhat similar pattern as shown in FIGS. 2 and 3. Furthermore, since the confronting strips 72, 74 of stub 66 generally have the same shape and confront each other along their lengths, stub 66 will be described with reference to the unique shape of strip 72 of stub 66 and it will be appreciated that strip 74 also has a similar, although confronting, shape.

Referring now to FIG. 2, strip 72 of stub 66 originates at a proximal end 92 and is attached via extension 69 to center conductor 44. A first leg 94 of strip 72 extends away from center conductor 44 and parallel to top edge 58 toward side edge 98 of substrate 50. A second leg 96 meets first leg 94 at a generally 90° bend and extends along side edge 98 generally parallel to the side edge 98 to a bottom edge 100 of substrate 50. At bottom edge 100, strip 72 makes another 90° bend and a third leg 102 extends generally parallel first leg 94 and along bottom edge 100. An inner edge 104 is defined by a rectangular slot 108 which is formed by removing a portion of substrate 50 so that one of the clips, such as clip 80 may be attached to the tuning stub 64 in the area of slot 108, if necessary, as discussed below. Strip 72 includes a fourth leg 106 which extends from third leg 102 and along inner edge 104 generally parallel to second leg 96. The fourth leg 106 extends back toward connector 34 and the proximal end 92 of strip 72 such that if the fourth leg 106 continued in that direction and connected at the proximal end 92 of strip 72, the legs 94, 96, 102 and 106 would form a loop-shaped stub which is closed, that is, continuous around the loop. However, fourth leg 106 is not as long as second leg 96 and terminates at a distal end 107 which is spaced from proximal end 92 center conductor 44 to define an open, rectangular-shaped loop.

As may be appreciated, the proximal and distal ends 92, 107 of strip 72 define the proximal and distal ends of stub 66. Similarly, the proximal and distal ends 110, 112 of strip 68 generally define the proximal and distal ends of stub 64 although stub 64 is longer than stub 66 as will now be described. Tuning stub 64 has generally the same shape as stub 66 including first, second, third and fourth legs which extend end to end, around the various edges of substrate 50 to define an open loop-shaped stub. Stub 64 further includes an extension leg 114 or fifth leg which extends from the defined distal end 112 and makes stub 64 physically longer than stub 66. Fifth leg 114 extends generally parallel bottom edge 100 and along a middle edge 116 defined by slot 108 terminates at an extended end 118 without actually contacting the distal end 107 of the fourth leg 106 of strip 72 of stub 66. Extended end 118 terminates stub 64 and defines the length of stub 64. Therefore, extended end 107 might also be termed a "distal" end similar to distal end 108 of stub 66. The increased physical, and hence, electrical length of stub 64 contributes to the overall tunability of the coupling network 12 over a broad range of cellular telephone frequencies.

As discussed above, the pairs of confronting strips 68, 70 and 72, 74 electrically form tuning stubs 64, 66, respectively, which have defined physical lengths. Each stub 64, 66 is tuned by giving the stub a defined electrical length, which is generally, although not necessarily, shorter than the physical length of the respective stub. The electrical lengths of the tuning stubs 64, 66 of coupling network 12 are defined by using selectively using conductive tuning clips 80, 82, respectively, which electrically connect the confronting strips of each stub together to electrically short the confronting strips at the clip.

To tune the coupling network 12, the coupling network is connected to a test set up (not shown) which models the operation of the transceiver 48 and cable 46 and antenna unit 14. Such a test set up might be configured to measure the Voltage Standing Wave Ratio or VSWR which provides a measurement of the power reflected at the connector 34, as such testing of a circuit is conventional in the art. A preferable tuning sequence begins by attaching the interior brass coupling plate 52 to one of the stubs, 64, 66, such as by electrically connecting plate 52 to strip 72 of stub 66. Once the coupling plate 52 has been attached, the tuning clips 80, 82 are placed on the respective stubs 64, 66. Slot 108 defined by a cut away portion of substrate 50 allows tuning clips 80, 82 to be connected across the substrate to connect together the confronting strips of the respective stubs over the entire lengths of the stubs. Clips 80 and 82 are preferably metal strips which are bent to contact the confronting conductive strips of the stubs, such as strips 68, 70 of stub 64, to electrically short strips 84, 85 together at a position along the length of stub 64. Shorting together the strips of a stub at a selected point along its length shortens the effective electrical length of the stub and thus varies the electrical impedance of the stub. The clips 80, 82 are slid or otherwise moved along the lengths of the stubs 64, 66, respectively, while the reflected power is measured at connector 34. Once the proper positions of the clips 80, 82 are determined to achieve the desired impedance matching between antenna unit 14 and transceiver cable 46 with minimum VSWR, the clips 80, 82 are securely fastened to their respective tuning stubs such as by soldering or some other suitable conductive attachment method.

When tuning coupling network 12, the clips 80, 82 are preferably moved individually and in conjunction with one another until the VSWR is lowered to a desirable minimum. It has been found that in tuning the coupling network 12 of the present invention, it is desirable to first move clip 82 along stub 66 to achieve a desirable impedance match and a low VSWR at the particular test frequency of the tuning signal, such as 850 MHz. Next, clip 80 is moved over the length of the longer stub 64 to further lower the VSWR and provide a good impedance match between the coupling network 12 and the transceiver cable 46. It has been found that the coupling network 12 is optimally tuned by placing tuning clip 82 on stub 66 at a position along the length of the stub 66 spaced further from connector 34 than the connection point 85 of plate 52. That is, the connection point 85 of plate 52 on stub 66 is between the connection point of clip 82 and the connection point of connector 34 on stub 66.

Through testing the present invention, it has been found that by keeping all other parameters constant, such as the size and shape of the coupling plates, 28, 52, the position of the coupling plate connection point on stub 66, the antenna unit 14, and the operating frequency of the test signal, then the locations of the clips 80, 82 for achieving minimum VSWR are generally the same between individual coupling networks. That is, once a prototype coupling network 12 has been tuned for a particular frequency band and antenna unit 14, then the clips 80, 82 may repeatedly be positioned at approximately the same positions on tuning stubs 64, 66 of additional similar coupling networks in order to tune those networks. Because of such consistency, a prototype coupling network may be tuned to a specific antenna and frequency range, and the location of the clips may be conveyed to the manufacturer who may place, but not solder, the clips 80, 82 on the substrate 50 at designated positions along the tuning stubs 64, 66, respectively. Then, the clips 80, 82 will only need to be slightly adjusted and soldered to completely tune the coupling network 12. Once tuned, the generally rigid dielectric substrate 50 ensures mechanical, and hence, electrical stability of the coupling network 12. While the stability of the coupling network 12 of the present invention promotes such production efficiency, this should in no way be taken to indicate that the clips 80, 82 will always be placed at the same positions along the tuning stubs 64, 66, because the coupling network 12 of the present invention may be used and tuned for different frequency ranges and a large variety of different antennas, as well as different dielectric substrate materials.

The unique configuration of the tuning stubs 64, 66 of the present invention yields a coupling network 12 which is tunable over each of the three available cellular telephone bands. That is, it is tunable over the 824–896 MHz U.S. band, the 806–866 MHz U.S. Special Mobile Radio (SMR) band, as well as the 895–960 MHz European band. Furthermore, it provides desirable impedance matching between the transceiver cable 46 and the antenna unit 14 for a large variety of currently available cellular telephone antennas when tuned for a specific antenna. Still further, the coupling network 12 produces desirable impedance matching with very low VSWR and very low radiation from the transceiver cable 46 and connector 34 without the use of a grounded shield or counterpoise covering the coupling network 12.

As mentioned, the dielectric substrate 50 may be a G-10 dielectric approximately 0.062 inches thick and having a dielectric constant of approximately 4.8. As mentioned the line width of strips 68, 72 is preferably around 0.1 inches along most of the strips lengths while the width of the confronting strips 70, 74 connected to outer shell conductor 42 is preferably around 0.12 inches along a major portion of the strips lengths. The thickness of the thin conductive strips deposited on the substrate is determined according to conventional PC board manufacturing techniques. The confronting conductive strips of these dimensions on a G-10 dielectric substrate 50 form tuning stubs 64, 66 having a characteristic input impedance of approximately 50 Ohms.

It is desirable in the coupling network 12 of the present invention that the combined physical length of the two stubs 64 and 66 end to end, is approximately at least one-half of a wavelength of the longest wavelength at which the coupling network 12 is to operate. Referring to FIG. 2, the combined length of the two stubs 64, 66 is defined by the distance from extended end 118 of stub 64 all the way along stub 64 and stub 66 and along the edges of substrate 50 to the distal end 107 of stub 66. It has been calculated that an 800 MHz electrical signal, propagating through conductive strips having a line width of approximately 0.111 inches on a dielectric board with a thickness of 0.062 inches and a dielectric constant of 4.8, has a one-half wavelength measurement of approximately 3.899 inches. The coupling network 12 of the present invention will generally be operating above 800 MHz. Accordingly, in an embodiment of the present invention, the combined length of the tuning stubs 64, 66 would be at least 3.899 inches.

After the coupling network 12 has been tuned with tuning clips 80, 82, it may be placed in line within a cellular telephone system to provide a good impedance match between an external antenna unit 14 and a transceiver 48 and cable 46. To do so, the coupler box 18 is closed about coupling network 12 and attached to the interior surface 20 of glass windshield 16 opposite an external antenna unit 14 installed against the exterior surface 15 of windshield 16. Coaxial cable 46, connected to transceiver 48, is threaded onto the connector 34 electrically coupled to the coupling network 12. The coupling network 12, thus installed, is ready for use without any further tuning and may be used over a wide range of cellular telephone frequencies to provide good impedance matching without further modification such as attaching a grounded shield or counterpoise adjacent the coupling network 12.

Accordingly, while the present invention has been illustrated by the description of an embodiment thereof, and while the embodiment has been described in considerable detail, it is not the intention of applicant to restrict or in any way limit the scope of the appended claims to such detail. Additional variations of the invention and additional advantages and modifications will readily appear to those skilled in the art. For example, the shape of the board and tuning strips might be modified to depart from the shapes and dimensions disclosed herein without departing from the operative features of the present invention. Furthermore, a different dielectric substrate might be utilized. Still further, the unique stub structure might be utilized by having strips on one surface of the substrate confronting a planar conductor such as a ground plane on the other surface to define the confronting strip. Therefore, the invention in its broader aspects is not limited to the specific details, representative apparatus and method, and illustrative examples or variations shown and described. Accordingly, departures may be made from such details without departure from the spirit or scope of applicant's general inventive concept.

What is claimed is:

1. A cellular telephone antenna to transceiver coupling network comprising:

a connector for coupling to a cellular transceiver, the connector having a center conductor and an outer shell;

a dielectric substrate having first and second opposing face surfaces;

a pair of tuning stubs, each including an elongated first conductive strip on the first face surface and an elongated second conductive strip on the second face surface in confronting relationship with the first strip of the stub, the confronting strips being of approximately equal width along a major portion of their lengths, one strip of each tuning stub being coupled to the center conductor of the connector and another strip of each tuning stub being coupled to the outer shell of the connector;

a conductive member associated with each of the stubs and being selectively attached at a location on the stub to electrically connect the confronting strips of the stub and tune the stub; and a conductive element electrically connected to one of the tuning stubs for coupling the coupling network to a cellular antenna;

whereby to provide electrical coupling between said cellular antenna and said cellular transceiver.

2. The coupling network of claim 1 further comprising a plastic housing, wherein said substrate and tuning stubs are supported within said plastic housing.

3. The coupling network of claim 1 wherein the strips of each stub are of a length such that the stubs may be tuned to provide impedance matching between said cellular antenna and said cellular transceiver over a range of frequencies of approximately 800 to 1,000 MHz.

4. The coupling network of claim 1 wherein each stub has a proximal end and a distal end and a length defined by the distance between the proximal end and the distal end, the combined length of both stubs being at least 3.9 inches.

5. The coupling network of claim 1 wherein the width of the said first strip of at least one stub is approximately 0.1 inches.

6. The coupling network of claim 1 wherein the width of the first strip of at least one stub is slightly less than the width of the second strip of that stub.

7. The coupling network of claim 6 wherein said first and second strips of at least one stub have width dimensions of approximately 0.1 and 0.12 inches, respectively, along a major portion of their lengths.

8. The coupling network of claim 1 wherein the tuning stubs each have a proximal end and a distal end, the conductive member associated with at least one of the stubs being connected to the stub between the proximal and distal ends of that stub.

9. The coupling network of claim 8 wherein the conductive element is connected to the stub between said proximal end and said conductive member.

10. The coupling network of claim 8 wherein the conductive element is connected to the first strip of said stub.

11. The coupling network of claim 1, wherein said conductive element is a coupling plate.

12. The coupling network of claim 11 further comprising a plastic housing, wherein said substrate and tuning stubs are supported within said plastic housing and said plate is secured to a portion of said housing.

13. The coupling network of claim 12 wherein said coupling plate is held by said plastic housing portion at a fixed distance from said substrate and stubs.

14. The coupling network of claim 1 wherein the substrate has a plurality of edges and the tuning stubs each have a proximal end and a distal end, at least one stub having a first portion extending away from the proximal end and around the substrate edges and a second portion extending from the first portion back toward the proximal end but terminating at the distal end spaced from the proximal end to define an open, generally loop-shaped pattern.

15. The coupling network of claim 14 wherein each of the tuning stubs defines an open, generally loop-shaped pattern on the substrate.

16. The coupling network of claim 15 further comprising an extension portion extending from the distal end of a first of the stubs to give the first stub a longer physical length than a second of the stubs.

17. The coupling network of claim 14 wherein the loop-shaped pattern includes a plurality of straight leg sections, connected end to end, such that the open, loop-shaped pattern has a generally rectangular shape.

18. The coupling network of claim 17 wherein at least one stub includes at least four successive leg sections connected end to end, a first leg section extending away from the proximal end to an edge of the substrate, a second leg section extending from the first leg section along the edge of the substrate, a third leg section extending from the second leg section and generally parallel to the first leg section, and a fourth leg section extending from the third leg section and generally parallel to the second leg section toward the proximal end but terminating at the distal end, the legs forming said rectangular, loop-shaped pattern.

19. The coupling network of claim 18 wherein each of the tuning stubs includes a said first, second, third and fourth leg section to define two rectangular, loop-shaped patterns on the substrate.

20. The coupling network of claim 19 further comprising a fifth leg section connected to the fourth leg section of a first of the stubs, the fifth leg giving the first stub a longer physical length than a second of the stubs.

21. The coupling network of claim 1 wherein at least one of said tuning stubs has an untuned, input impedance of approximately 50 ohms.

22. The coupling network of claim 1 wherein said substrate has a dielectric constant of approximately 4.8.

23. The coupling network of claim 1 wherein said first and second strips of at least one stub have width dimensions of approximately 0.1 and 0.12 inches, respectively, along a major portion of their lengths.

24. The coupling network of claim 1 wherein said dielectric is generally rigid to provide a stable base for said tuning stubs.

25. A cellular telephone antenna to transceiver coupling network comprising:

a connector for coupling to a cellular transceiver, the connector having a center conductor and an outer shell;

a dielectric substrate having first and second opposing face surfaces and a plurality of edges;

a pair of tuning stubs, each including an elongated first conductive strip with a proximal end and a distal end on one of the face surfaces and a conductive pattern on another of the face surfaces confronting the first strip, the proximal ends of the first strips of the tuning stubs being coupled to the center conductor of the connector and the conductive patterns of the tuning stubs being coupled to the outer shell of the connector;

the first strip of at least one of the stubs having a first portion extending away from the proximal end and connector and along the substrate edges and a second portion extending from the first portion back toward the strip proximal end but terminating at the distal end spaced from the proximal end to define an open, generally loop-shaped pattern;

a respective conductive member associated with each of the stubs and being selectively attached at a location on the stub to electrically connect the first strip and conductive pattern of the stub and tune the stub; and a conductive element electrically connected to one of the tuning stubs for coupling the coupling network to cellular antenna;

whereby to provide electrical coupling between said cellular antenna and said cellular transceiver.

26. The coupling network of claim 25 wherein the conductive pattern is a second conductive strip, the second strip of each tuning stub being in confronting relationship with the first strip thereof along the length of that first strip.

27. The coupling network of claim 25 wherein the strips of each stub are of a length such that the stubs may be tuned to provide impedance matching between said cellular antenna and said cellular transceiver over a range of frequencies of approximately 800 to 1,000 MHz.

28. The coupling network of claim 25 wherein the first strips of the tuning stubs each have a proximal end and a distal end, the conductive member associated with at least one of the stubs being connected to the stub between the proximal and distal ends of that strip.

29. The coupling network of claim 28 wherein the conductive element is connected to the strip of the stub between the strip proximal end and the conductive member.

30. A cellular telephone antenna to transceiver coupling network comprising:

a connector for coupling to a cellular transceiver, the connector having a center conductor and an outer shell;

a dielectric substrate having first and second opposing face surfaces and a top edge, bottom edge and side edges;

a pair of tuning stubs, each including an elongated first conductive strip with a proximal end and a distal end on one of the face surfaces and a conductive pattern on another of the face surfaces confronting the first strip, each of the proximal ends of the first strips being coupled to the center conductor of the connector and the conductive patterns of the tuning stubs being coupled to the outer shell of the connector;

the first strip of at least one of the tuning stubs including at least four successive leg sections connected end to end, a first leg section extending away from said proximal end to an edge of the substrate, a second leg section extending from the first leg section along the edge, a third leg section extending from the second leg section generally parallel to the first leg section, and a fourth leg section extending from the third leg section generally parallel to the second leg section and toward said proximal end but terminating at said distal end, said legs forming a rectangular, loop-shaped pattern;

a conductive member associated with each of the stubs and being selectively attached at a location on the stub to electrically connect the first strip and second pattern of the stub and tune the stub; and a conductive element electrically connected to one of the tuning stubs for coupling the coupling network to cellular antenna;

whereby to provide electrical coupling between said cellular antenna and said cellular transceiver.

31. A method of coupling a cellular telephone antenna to a cellular telephone transceiver comprising:

providing a dielectric substrate having first and second opposing face surfaces and a connector having a center conductor and an outer shell;

forming a pair of tuning stubs on said substrate by (i) positioning, for each stub, an elongated first conductive strip on said first face surface and an elongated second conductive strip on said second face surface in confronting relationship to the first strip, and (ii) dimensioning the strips of each stub to have approximately equal widths along a major portion of their lengths;

coupling one strip of each of the tuning stubs to the center conductor of the connector and another strip of each of the tuning stubs to the outer shell of the connector;

for each stub, selectively, electrically connecting the confronting strips of the stub together whereby to tune the stubs;

connecting a cellular telephone transceiver to the connector with a coaxial cable; and coupling a cellular telephone antenna to one of the tuning stubs.

32. The method of claim 31 further comprising:

dimensioning the strips of each stub in length such that the stubs may be tuned to provide coupling between said cellular antenna and said cellular transceiver over a range of frequencies approximately 800 to 1,000 MHz.

33. The method of claim 31 further comprising:

dimensioning at least one of the strips coupled to the connector center conductor to have a width dimension less than the width dimension of the other strip of that stub.

34. The method of claim 31 wherein at least one of the tuning stubs has a proximal end and a distal end, the method further comprising:

electrically connecting the strips of that stub between the proximal and distal ends thereof.

35. The method of claim 31 wherein the antenna is coupled to the one stub.

36. The method of claim 31 further comprising surrounding the substrate and tuning stubs with a plastic housing.

37. The method of claim 31 wherein the substrate has a plurality of edges and the tuning stubs each have a proximal end and a distal end, the method further comprising forming at least one stub to have a first portion extending away from the proximal end and around the substrate edges and a second portion extending from the first portion back toward the proximal end but terminating at the distal end spaced from the proximal end to define an open, generally loop-shaped pattern.

38. The method of claim 37 further comprising forming said first conductive strip to include a plurality of straight leg sections, connected end to end, such that the open, loop-shaped pattern has a generally rectangular shape.

39. The method of claim 38 wherein the first strip includes at least four successive leg sections connected end to end, the method further comprising:

positioning a first leg section to extend away from the proximal end to an edge of the substrate;

positioning a second leg section to extend from the first leg section along the edge of the substrate;

positioning a third leg section to extend from the second leg section and generally parallel to the first leg section; and positioning a fourth leg section to extend from the third leg section and generally parallel to the second leg section toward the proximal end but terminating at the distal end, such that said legs end, form said rectangular, loop-shaped pattern.

40. The method of claim 39 further comprising forming both of the tuning stubs to include a said first, second, third and fourth leg section to define two rectangular loop-shaped patterns on the substrate.

41. The method of claim 40 further comprising forming a fifth leg section connected to the fourth leg section of a first of the stubs to give the stub a longer physical length than a second of the stubs.

42. The method of claim 37 further comprising forming both of the tuning stubs to define an open, generally loop-shaped pattern on the substrate.

43. The method of claim 42 further comprising forming an extension portion extending from said distal end of a first of the stubs to give the first stub a longer physical length than a second of the stubs.

* * * * *